US007837362B2

(12) United States Patent
Zhang

(10) Patent No.: US 7,837,362 B2
(45) Date of Patent: Nov. 23, 2010

(54) LED LAMP WITH AN IMPROVED SEALED STRUCTURE

(75) Inventor: Wen-Xiang Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 191 days.

(21) Appl. No.: 12/241,067

(22) Filed: Sep. 30, 2008

(65) Prior Publication Data

US 2010/0079991 A1 Apr. 1, 2010

(51) Int. Cl.
*F21V 29/00* (2006.01)

(52) U.S. Cl. ..... 362/373; 362/218; 362/294

(58) Field of Classification Search ..... 362/218, 362/241, 249.02, 267, 294, 362, 373, 547
See application file for complete search history.

(56) References Cited

U.S. PATENT DOCUMENTS 7,293,898 B2 * 11/2007 Kumthampinij et al. .... 362/294
2009/0196037 A1 * 8/2009 Xiao et al. ..... 362/249.02
2009/0310381 A1 * 12/2009 Chang et al. ..... 362/373

* cited by examiner

*Primary Examiner*—Y My Quach Lee
(74) *Attorney, Agent, or Firm*—Frank R. Niranjan

(57) ABSTRACT

An LED lamp includes a housing, a heat sink received in the housing, a plurality of LED modules thermally attached to the heat sink and a cover covering on the housing and engaging with the housing. The cover includes a base plate and an annular flange extending towards the housing from the base plate. The heat sink includes a base and fins extending from the base. The base is mounted on the annular flange of the cover. The fins extend through the cover to be exposed outside. A waterproof gasket is firmly and intimately compressed between the annular flange of the cover and the base of the heat sink, whereby the housing and the base of the heat sink defines a hermetical cavity receiving the LED modules therein.

9 Claims, 4 Drawing Sheets

LED LAMP WITH AN IMPROVED SEALED STRUCTURE

BACKGROUND OF THE INVENTION

1. Field of the Invention

The present invention relates to an LED lamp, and particularly to an LED lamp having an improved sealed structure.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

When the LED lamp is used outdoors for illumination, the LED lamp needs to be constructed with a sealed structure to protect the LEDs in the LED lamp from damages which may be caused by rain, snow, dust or other foreign articles.

Therefore, an LED lamp which has an improved sealed configuration is desired.

SUMMARY OF THE INVENTION

According to a preferred embodiment of the present invention, an LED lamp includes a housing, a heat sink received in the housing, a plurality of LED modules thermally attached to the heat sink and a cover covering on the housing and engaging with the housing. The cover includes a base plate and an annular flange extending towards the housing from the base plate. The heat sink includes a base and fins extending from the base. The base is mounted on the annular flange of the cover. The fins extend through the cover and thus are exposed outside. A waterproof gasket is firmly and intimately compressed between the annular flange of the cover and the base of the heat sink, whereby the housing and the base of the heat sink cooperatively define a hermetical cavity receiving the LED modules 20 therein.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
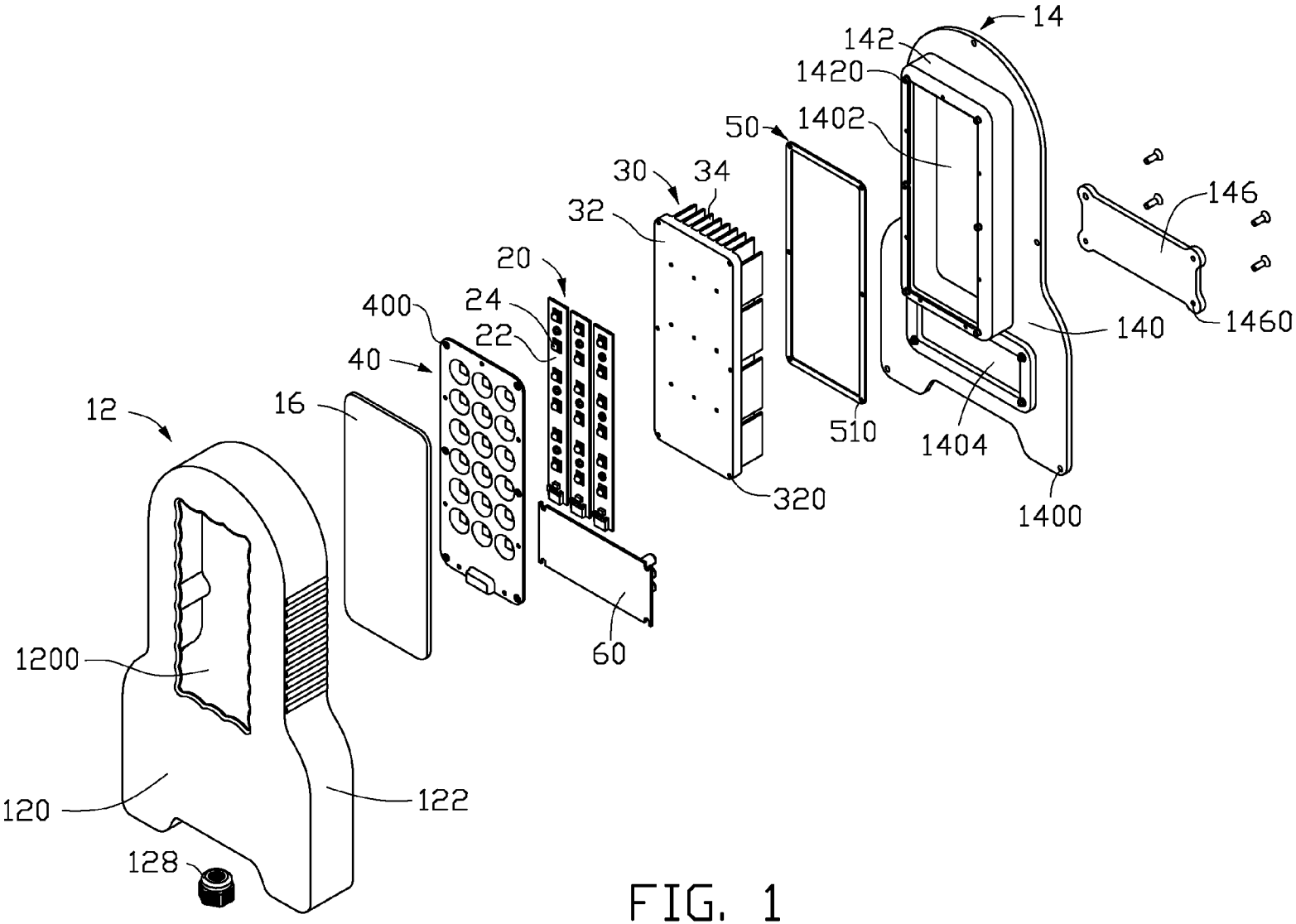
FIG. 1 is an exploded, isometric view of an LED lamp in accordance with a preferred embodiment of the present invention.
Figure 2:
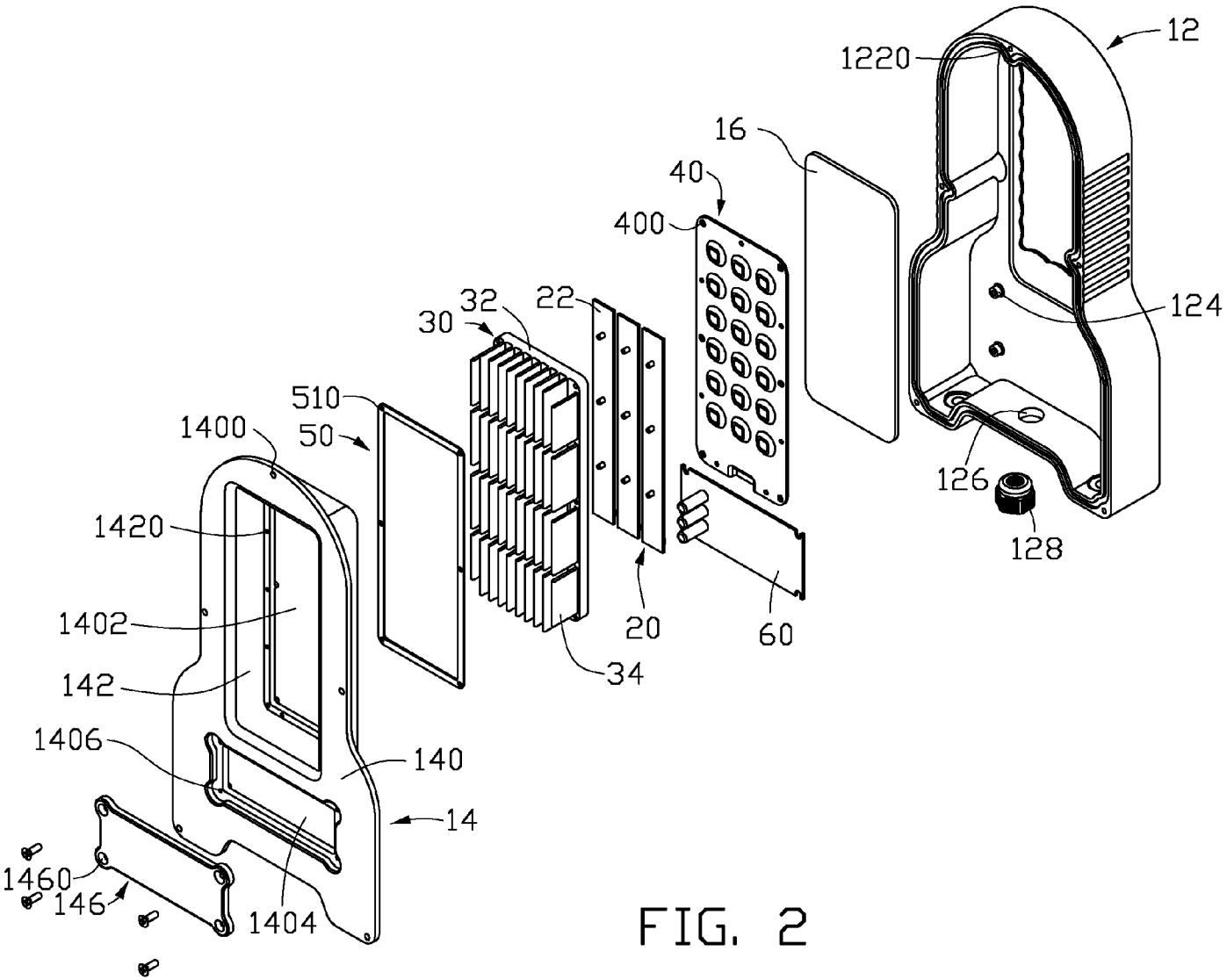
FIG. 2 is a view similar to FIG. 1, viewed from an opposite aspect.
Figure 3:
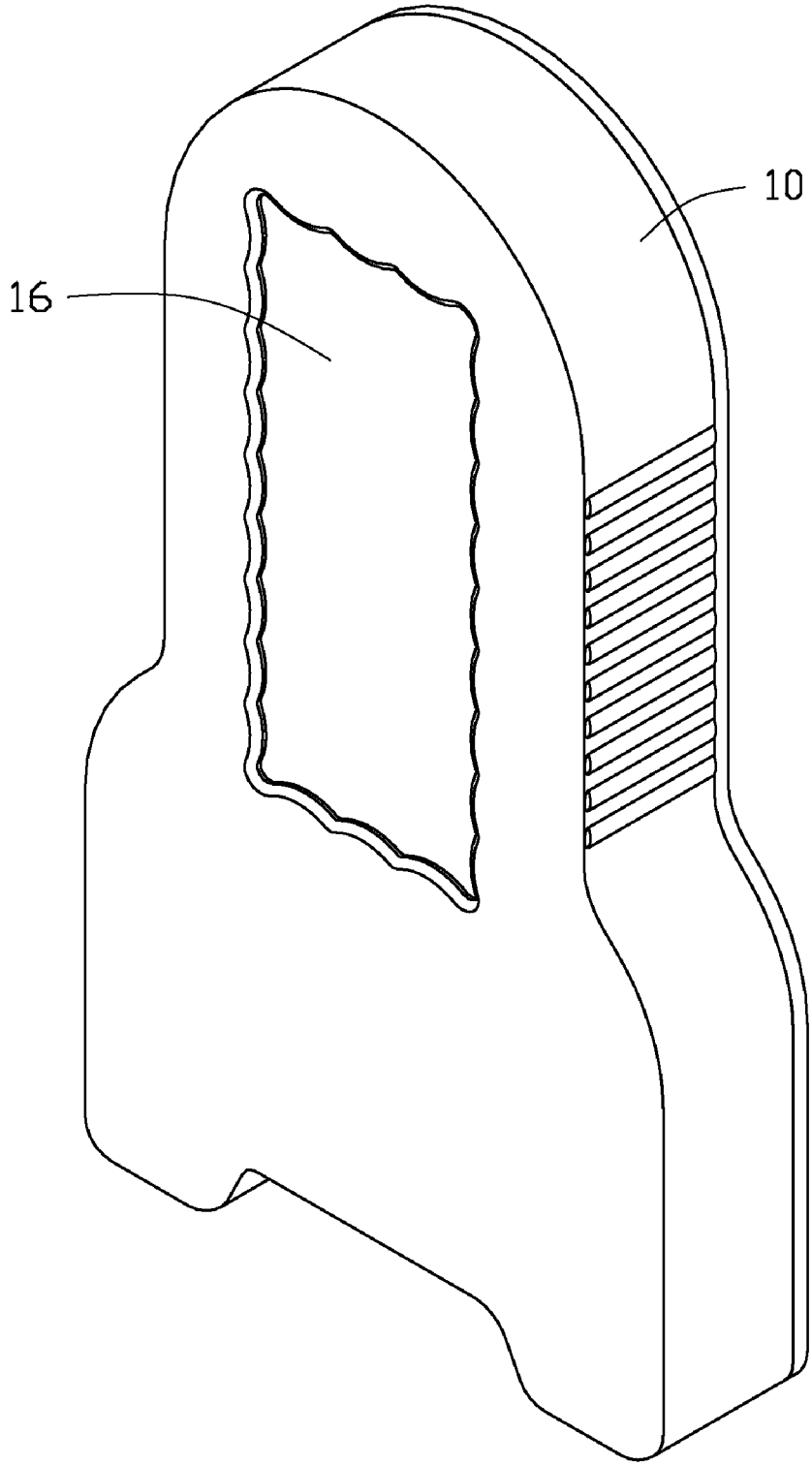
FIG. 3 is an assembled, isometric view of FIG. 1.
Figure 4:
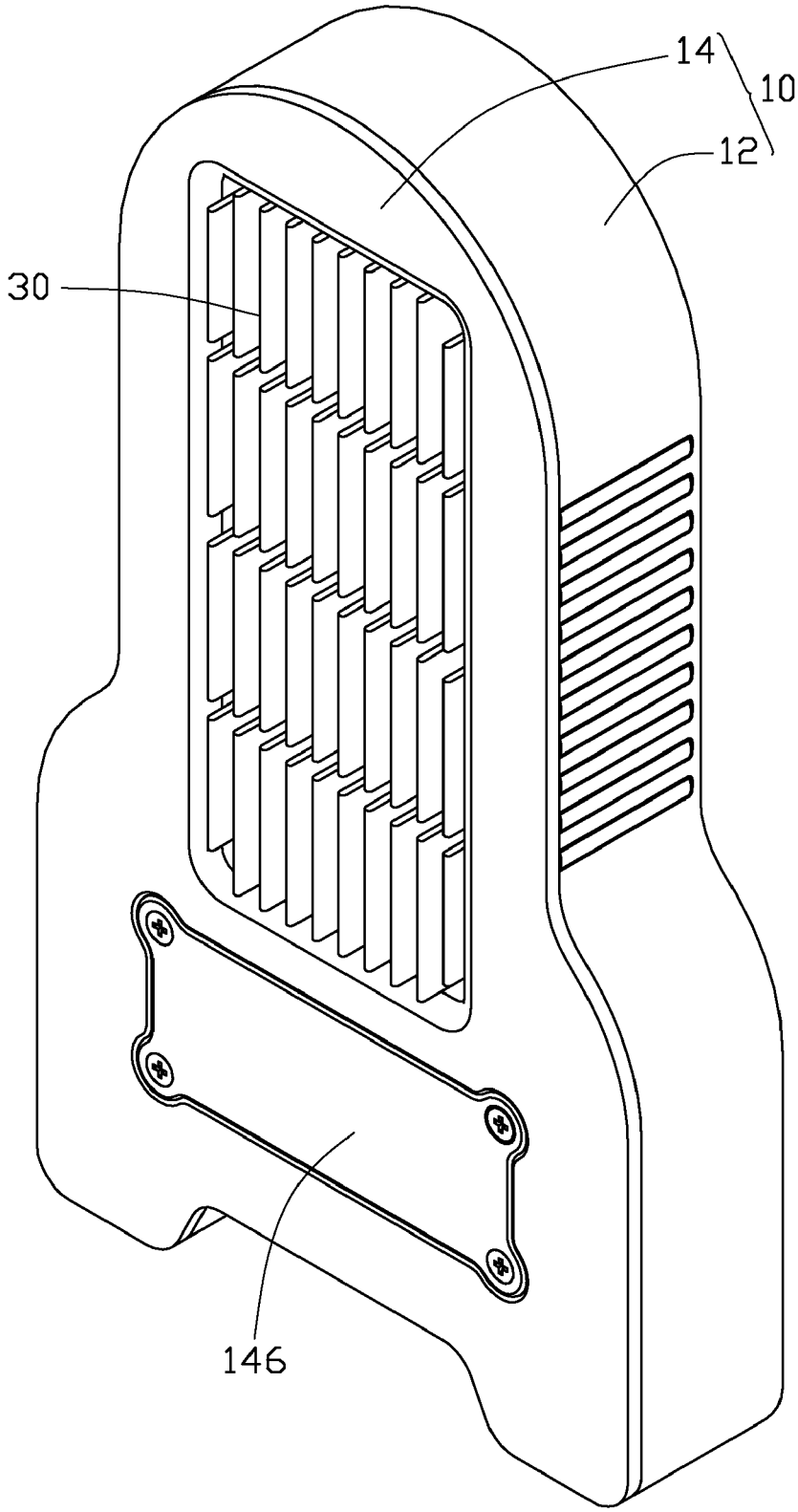
FIG. 4 is an assembled, isometric view of FIG. 2.

Referring to FIGS. 1-4, an LED lamp 10 comprises a heat sink 30, a plurality of LED modules 20 thermally attached to the heat sink 30, a reflecting plate 40 placed over the LED modules 20 and fixed to the heat sink 30, a housing 12 covering the heat sink 30 and a cover 14 engaging with the housing 12. A waterproof gasket 50 received in the housing 12 is compressed between the heat sink 30 and the cover 14. A lens 16 attached to the housing 12 is arranged between the housing 12 and the reflecting plate 40. A driving circuit module 60 is received in the LED lamp 10 and electronically connects with the LED modules 20 to supply power to the LED modules 20.

The housing 12 has a tower-shaped configuration and comprises a tower-shaped main body 120 and an annular connecting wall 122 extending perpendicularly from an outer edge of the main body 120 to define a space for receiving the heat sink 30 therein. A substantially rectangular opening 1200 is defined in the main body 120 of the housing 12 at a center of an upper part thereof. The lens 16 is attached on an inner surface of the main body 120 and covers the opening 1200. Light emitted by the LED modules 20 travels through the lens 16 and the opening 1200 of the housing 12 to illuminate an outside of the LED lamp 10. A plurality of protruding portions 124 are formed on the inner surface of the main body 120 of the housing 12, for supporting and securing the driving circuit module 60 to the housing 12. A circular bore 126 is defined in the connecting wall 122 at a bottom of the housing 12. A waterproof connector 128 is mounted to the circular bore 126 for connecting with a mating connector (not shown), whereby the LED modules 20, which are electrically connected with the waterproof connector 126 via wires (not shown) can connect with a power source. A plurality of orifices 1220 are defined in ears (not labeled) extending inwardly from a side edge of the connecting wall 122 and spaced from each other.

The cover 14 has a tower-shaped base plate 140 mating with the shape of the housing 12 and a lid 146 secured to a lower portion of the base plate 140. The base plate 140 has a size identical to that of the connecting wall 122 of the housing 12, whereby the base plate 140 of the cover 14 cooperates with the housing 12 to form a space for receiving the LED modules 20, the heat sink 30, the reflecting plate 40, the lens 16 and the driving circuit module 60 therein. A substantially rectangular opening 1402 is defined at a center of the base plate 140, whereby the heat sink 30 is communicated with the atmosphere via the opening 1402. An annular flange 142 extends perpendicularly from an inner side edge of the base plate 140 around the opening 1402, thereby defining a receiving space (not labeled) for accommodating fins 34 of the heat sink 30 therein. A rectangular window 1404 is defined in the base plate 140 at the lower portion thereof, for facilitating repair and maintenance of the driving circuit module 60 from the outside the LED lamp 10 via the window 1404. A plurality of screw holes 1400 are defined in the base plate 140 and adjacent to a side edge thereof, corresponding to the orifices 1220 of the housing 12. Fasteners (not shown) are used to extend through the screw holes 1400 of the cover 14 and screw into the orifices 1220 of the housing 12 to combine the cover 14 and the housing 12 together. A plurality of holes 1420 are defined in a top edge of the annular flange 142, for extension of fasteners (not shown) therethrough and through holes 510 of the waterproof gasket 50 into fixing holes 320 defined in a rectangular base 32 of the heat sink 30 to mount the heat sink 30 and the waterproof gasket 50 onto the top edge of the annular flange 142 of the housing 12. The fixing holes 320 are defined in four corners and middles of long, lateral sides of the base 32 of the heat sink 30. The lid 146 has a shape mating with the window 1404 and defines four mounting holes 1460 in four corners thereof. The lid 146 covers the window 1404 and is mounted to the lower portion of the cover 14 via screws (not labeled) extending through the mounting holes 1460 and screwing into holes 1406 defined in the base plate 140 adjacent to the window 1404.

The heat sink 30 is made from a metal block with a good heat conductivity. The heat sink 30 comprises the substantially rectangular base 32 and the plurality of fins 34 integrally extending from the base 32.

The LED modules 20 are thermally attached to a bottom surface of the base 32 of the heat sink 30 and arranged closely side by side to each other. Each of the LED modules 20 comprises an elongated printed circuit board 22 and a plurality of LEDs 24 mounted on the printed circuit board 22 and arranged in a line along a lengthways direction of the printed circuit board 22. The printed circuit boards 22 are secured on the bottom surface of the base 32 and parallel to the long, lateral sides of the base 32 of the heat sink 30.

The reflecting plate 40 is used as a reflector and reflects light emitted by the LED modules 20 to travel through the lens 16 of the housing 12 to illuminate the outside of the LED lamp 10. The reflecting plate 40 has a substantially rectangular configuration and defines a plurality of through holes 400 in four corners and middles of long, lateral sides thereof, for extension of fasteners (not shown) therethrough into the fixing holes 320 of the base 32 of the heat sink 30 to mount the reflecting plate 40 on the bottom surface of the base 32 of the heat sink 30, whereby the reflecting plate 40 is attached to and located over the LED modules 20.

The waterproof gasket 50 is substantially a rectangular ring and has a size identical to that of the annular flange 142 of the cover 14. The plurality of holes 510 are defined in four corners and middles of long, lateral beams of the waterproof gasket 50, for extension of the fasteners therethrough.

In assembly, the driving circuit module 60 received in a lower portion of the housing 12 is mounted to and supported by the protruding portions 124 of the housing 12. The fins 34 of the heat sink 30 are received in the receiving space defined by the annular flange 142 of the cover 14. The top edge of the annular flange 142 is securely attached to the base 32 of the heat sink 30, in which the waterproof gasket 50 is compressed therebetween. The fasteners extend through the reflecting plate 40 and engage into the base 32 of the heat sink 30, thereby securing the reflecting plate 40 to the base 32 of the heat sink 30 and over the LED modules 20. The fasteners extend through the cover 14 and engage with the housing 12 to assembly the LED lamp 10 together. The waterproof gasket 50 is firmly and intimately compressed between the annular flange 142 of the cover 14 and the base 32 of the heat sink 30, whereby the housing 12, the base 32 of the heat sink 30 and the cover 14 are hermetically connected together. The LED modules 20 are mounted on the base 32 of the heat sink 30 by screws (not shown) extending through the printed circuit boards 22 and screwing into the base 32 of the heat sink 30. The lens is glued to an side of the housing 12 around the opening 1200. Accordingly, the components of the LED lamp 10 are sealed in a cavity defined between the housing 12 and the cover 14. Specifically, the LED modules 20 are received in a hermetical cavity defined between the base 32 of the heat sink 30 and the housing 12.

In use, heat generated by the LED modules 20 is absorbed by the heat sink 32 via the base 32 and finally dispersed into ambient cool air via the fins 34 exposed outside.

According to the preferred embodiment of the present invention, the waterproof gasket 50 is firmly and intimately compressed between the base 32 of the heat sink 30 and the annular flange 142 of the cover 14, thereby enabling the LED modules 20 to be sealed in the cavity cooperatively defined by the housing 12 and the base 32 of the heat sink 30. Thus, the LED modules 20 can be protected from damage which may be caused by rain, snow, dust or other foreign articles. Additionally, since the fins 34 of the heat sink 30 extending through the opening 1402 of the cover 14 are exposed outside, the heat generated by the LED modules 20 is quickly and effectively dissipated to ambient cool air via the fins 34 of the heat sink 30. Therefore, a temperature of the LED modules 20 can be kept below a set value so that the LED modules 20 can always work normally to generate the required illumination.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing wherein the housing comprises a main body and a connecting wall extending from a side edge of the main body;

a heat sink received in the housing, the heat sink comprising a base and a plurality of fins extending from the base;

a plurality of LED modules covering by the housing and thermally attached to the base of the heat sink;

a reflecting plate attached to the LED modules and mounted on the base of the heat sink;

a cover comprising a base plate mating with the housing and engaging with the housing to secure the cover to the housing, an opening being defined in the base plate and an annular flange extending the base plate around the opening to define a receiving space for accommodating the fins of the heat sink therein; and a driving circuit module received in the housing and mounted on the main body of the housing;

wherein the base of the heat sink is mounted on the annular flange of the cover and the fins of the heat sink are exposed outside via the opening of the cover, and wherein a waterproof gasket is firmly and intimately compressed between the annular flange of the cover and the base of the heat sink so that the base of the heat sink and the housing cooperatively define a hermetical cavity receiving the LED modules therein;

wherein the base plate of the cover is coupled to the connecting wall of the housing; and wherein the main body of the housing comprises a plurality of protruding portions engaging with the driving circuit module to secure the driving circuit module to the housing.

2. The LED lamp as claimed in claim 1, wherein the main body of the housing defines an opening therein and a lens is attached on the housing and covers the opening.

3. The LED lamp as claimed in claim 1, wherein the cover comprises a lid covering a window in the base plate located corresponding to the driving circuit module, adapted for facilitating a maintenance of the driving circuit module in the LED lamp through the window.

4. The LED lamp as claimed in claim 1, wherein the connecting wall of the housing defines a plurality of orifices, fasteners extending through the base plate of the cover and engage in the orifices to combine the cover and housing together.

5. The LED lamp as claimed in claim 1, wherein the annular flange of the cover is extended towards the housing and received in the housing.

6. An LED lamp comprising:

a housing wherein the housing comprises a main body and a connecting wall extending from a side edge of the main body;

a heat sink received in the housing, the heat sink comprising a base and a plurality of fins extending from the base;

a plurality of LED modules covering by the housing and thermally attached to the base of the heat sink;

a reflecting plate attached to the LED modules and mounted on the base of the heat sink;

a cover comprising a base plate mating with the housing and engaging with the housing to secure the cover to the housing, an opening being defined in the base plate and an annular flange extending the base plate around the opening to define a receiving space for accommodating the fins of the heat sink therein; and a driving circuit module received in the housing and mounted on the main body of the housing;

wherein the base of the heat sink is mounted on the annular flange of the cover and the fins of the heat sink are exposed outside via the opening of the cover, and wherein a waterproof gasket is firmly and intimately compressed between the annular flange of the cover and the base of the heat sink so that the base of the heat sink and the housing cooperatively define a hermetical cavity receiving the LED modules therein;

wherein the base plate of the cover is coupled to the connecting wall of the housing; and wherein the cover comprises a lid covering a window in the base plate located corresponding to the driving circuit module, adapted for facilitating a maintenance of the driving circuit module in the LED lamp through the window.

7. The LED lamp as claimed in claim 6, wherein the main body of the housing defines an opening therein and a lens is attached on the housing and covers the opening.

8. The LED lamp as claimed in claim 6, wherein the connecting wall of the housing defines a plurality of orifices, fasteners extending through the base plate of the cover and engage in the orifices to combine the cover and housing together.

9. The LED lamp as claimed in claim 6, wherein the annular flange of the cover is extended towards the housing and received in the housing.

* * * * *